US011904256B2

(12) United States Patent
Chen

(10) Patent No.: US 11,904,256 B2
(45) Date of Patent: Feb. 20, 2024

(54) INTERNAL FUNCTIONAL DEVICE FOR SIMULATIVE SNOWFALL

(71) Applicant: Yikui Chen, Chaozhou (CN)

(72) Inventor: Yikui Chen, Chaozhou (CN)

( * ) Notice: Subject to any disclaimer, the term of this patent is extended or adjusted under 35 U.S.C. 154(b) by 423 days.

(21) Appl. No.: 17/321,493

(22) Filed: May 16, 2021

(65) Prior Publication Data

US 2022/0184519 A1 Jun. 16, 2022

(30) Foreign Application Priority Data

Dec. 11, 2020 (CN) ..... 202022944721.1

(51) Int. Cl.
*A63J 5/02* (2006.01)

(52) U.S. Cl.
CPC ..... *A63J 5/028* (2013.01)

(58) Field of Classification Search
CPC ..... A63J 5/028; G09F 19/00; G09F 19/08
See application file for complete search history.

(56) References Cited

U.S. PATENT DOCUMENTS

2002/0106249 A1* 8/2002 Lin ..... G09F 19/02 406/106
2005/0120602 A1* 6/2005 Skinner ..... G09F 19/10 40/410
2014/0124592 A1* 5/2014 Quee ..... A63J 5/028 239/14.2
2017/0157526 A1* 6/2017 Quee ..... A63J 5/028

* cited by examiner

*Primary Examiner* — Gary C Hoge
(74) *Attorney, Agent, or Firm* — Jeenam Park

(57) ABSTRACT

The invention discloses an internal functional device for simulative snowfall, comprising a lampshade installing a lamp cover and an air blower on the top and bottom thereof, and a transparent sheet framework at upper part thereof with a foam particle dispersion net and an air guide elbow at the right-side upper end thereof, wherein the side part of the air blower is connected to an air guide slot with a material collecting slot having upper and lower hose clamps at left-side upper and lower ends as well as air guide tubes at right-side upper end in the upper end thereof. The device effectively pushes foam particles therein to move, making them convey onto the upper part of the foam particle dispersion net through the air guide tubes and further freely fall into the material collecting slot slowly in a circulating mode.

6 Claims, 3 Drawing Sheets

INTERNAL FUNCTIONAL DEVICE FOR SIMULATIVE SNOWFALL

TECHNICAL FIELD

The invention relates to the technical field of simulative snowfall devices, in particular to an internal functional device for simulative snowfall.

BACKGROUND

With the development of the film and television industry, the demand for the scene on television has been increasingly higher as some scenarios need to render with a snow scene to express a particular story and emotion. In a real natural environment, snowfall cannot be achieved at any time, and therefore, a device for simulative snowfall is needed to achieve such scene. To improve the internal function of the device for simulative snowfall, the invention discloses an internal functional device for simulative snowfall.

As an internal functional device for simulative snowfall on the market is simple in using process and structure, poor in acting effect on foam particles, it is relatively troublesome to mount and dismount and cannot be accurately located, thus brings inconvenience to use as a result of poor tightness after internal parts are mounted, the invention discloses a novel internal functional device for simulative snowfall.

SUMMARY

The objective of the invention is to provide an internal functional device for simulative snowfall to solve the problems that an internal functional device for simulative snowfall in the prior art is simple in using process and structure, poor in acting effect on foam particles, is relatively troublesome to mount and dismount, cannot be accurately located, and brings inconvenience to use as a result of poor tightness after internal parts are mounted To achieve the objective, the invention provides the following technical solution: an internal functional device for simulative snowfall includes a lampshade installing a lamp cover and an air blower on the top and bottom thereof, and a transparent sheet framework at upper part thereof, installing a foam particle dispersion net at the upper part thereof and an air guide elbow at the right-side upper end thereof, where the side part of the air blower is connected to an air guide slot with a material collecting slot having upper and lower hose clamps at left-side upper and lower ends as well as air guide tubes at right-side upper end in the upper end thereof.

Preferably, the air blower and the lampshade are fixedly connected, and the lampshade and the lamp cover are fixedly connected.

Preferably, the material collecting slot and the lampshade are fixedly connected, and the material collecting slot is of tapered structure.

Preferably, the air guide slot and the material collecting slot are in blocking connection, and the air guide slot is of branched structure.

Preferably, the four air guide tubes and the air guide elbow are in blocking connection, and the four air guide tubes and the transparent sheet framework are in blocking connection.

Preferably, the foam particle dispersion net and the transparent sheet framework are in blocking connection, and the area of the foam particle dispersion net is equal to that of the transparent sheet framework.

Compared with the prior art, the invention has the following beneficial effects:

According to the internal functional device for simulative snowfall disclosed by the invention, the air blower and the lampshade are fixedly connected, the lampshade and the lamp cover are fixedly connected; the air blower is arranged to provide power for the simulative snowfall device, effectively promoting circulation of foam particles inside the simulative snowfall device; the lamp cover is connected to the lampshade for sealing the upper end of the lampshade, so that the foam particles are prevented from leaking outsides and falling down under the action of upper pressure of the foam particles; the material collecting slot and the lampshade are fixedly connected, and the material collecting slot is of tapered structure for effectively separating the air blower partially, so that influence, on the air blower, after the foam particles fall down is avoided, and the foam particles are conveniently guided into the air guide tube intensively under the action of the tapered structure of the material collecting slot.

According to the internal functional device for simulative snowfall disclosed by the invention, the air guide slot and the material collecting slot are in blocking connection for positioning and forming the air guide slot in the material collecting slot; the air guide slot is of branched structure for guiding in the foam particles in two directions to disperse the foam particles more uniformly; the air guide tube and the air guide elbow are in blocking connection, the air guide tube and the transparent sheet framework are in blocking connection; through the blocking connecting structures between the four air guide tubes and the transparent sheet framework, firmness and tightness of the air guide tube connecting structure are improved; the upper parts of two air guide tubes at the left side connect with the air guide elbow, so that the foam particles are conveniently guided in, and are prevented from flowing back from the air guide tubes at the left side under the action of the air guide elbow; and the two air guide tubes at the right side are in butt joint to the upper part of the left side of the material collecting slot, so that relatively great foam particles can conveniently flow back.

According to the internal functional device for simulative snowfall disclosed by the invention, the foam particle dispersion net and the transparent sheet framework are in blocking connection, and are equal in area; the foam particle dispersion net is arranged, so that the foam particles are dispersed under the action of pressure to improve uniformity during falling-down, and can freely fall down slowly; and the blocking connecting structure between the foam particle dispersion net and the transparent sheet framework is convenient for positioning and mounting of the foam particle dispersion net, improving firmness in the using process of the foam particle dispersion net.

In the figures: 1. lampshade; 2. air blower; 3. air guide slot, 4. material collecting slot, 5. upper hose clamp: 6. lower hose clamp: 7. air guide tube; 8. transparent sheet framework; 9. foam particle dispersion net; 10. air guide elbow; and 11. lamp cover.

DESCRIPTION OF THE INVENTION

In order to more clearly illustrate the technical solutions in the examples of the invention, the figures used in the description of the examples will be briefly described below. It is obvious that the figures in the following description are only some examples of the invention. Other figures can also be obtained from those of ordinary skill in the art based on these figures without paying any creative effort.

Figure 1:
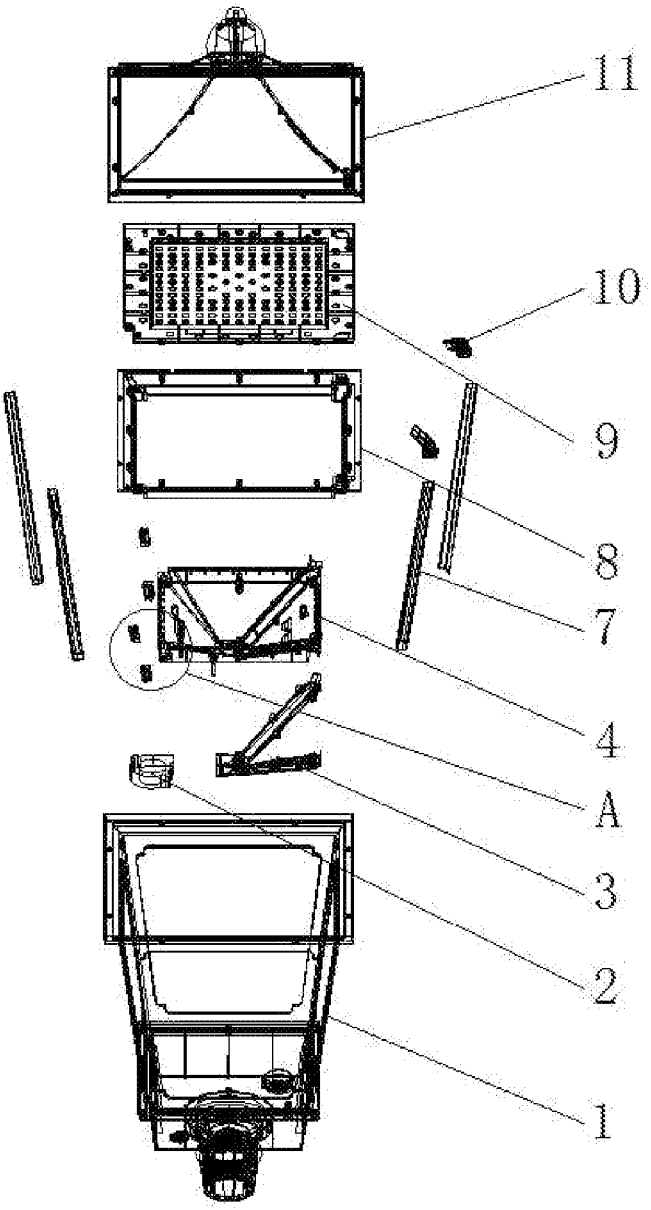
FIG. 1 is a schematic diagram of an explosive structure of the invention.
Figure 2:
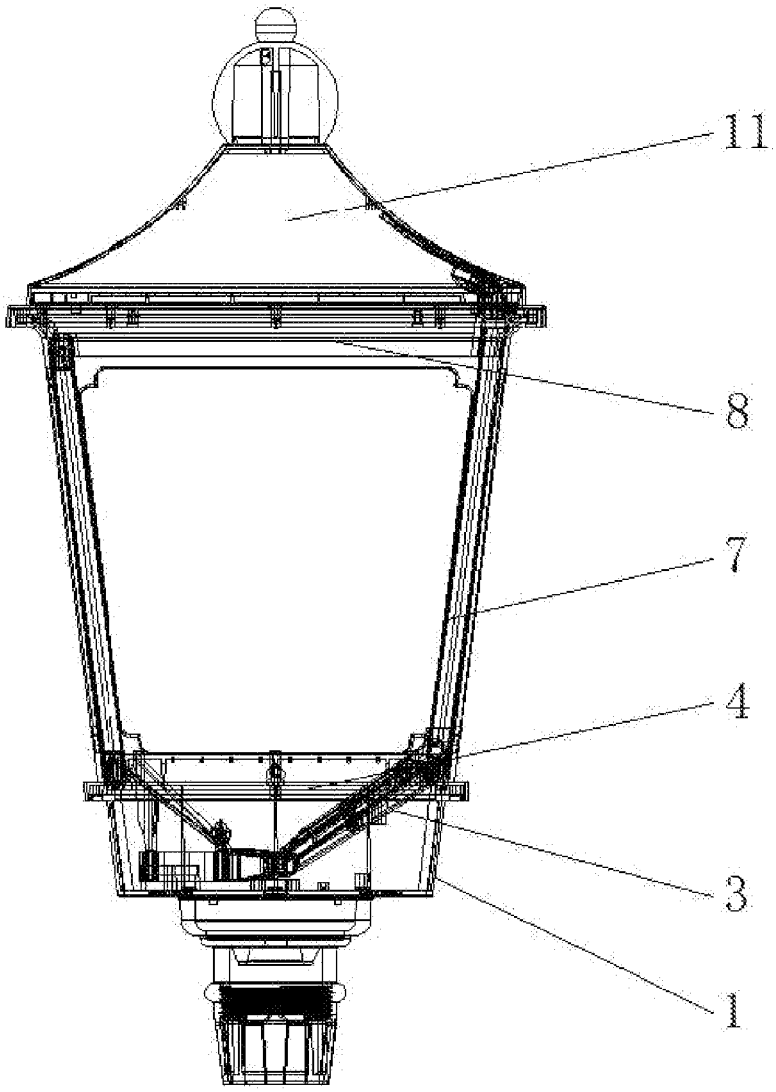
FIG. 2 is a schematic diagram of an outer structure of the invention.
Figure 3:
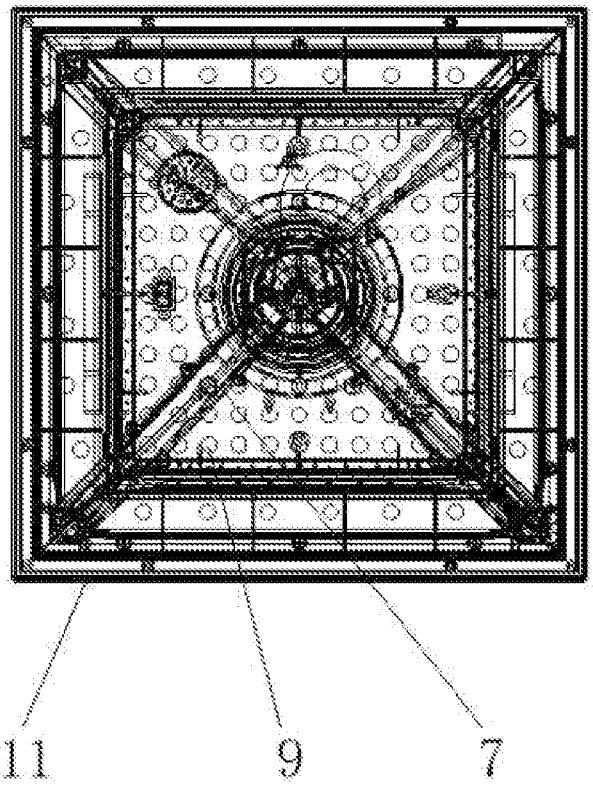
FIG. 3 is a schematic diagram of an overhead-view structure of the invention.
Figure 4:
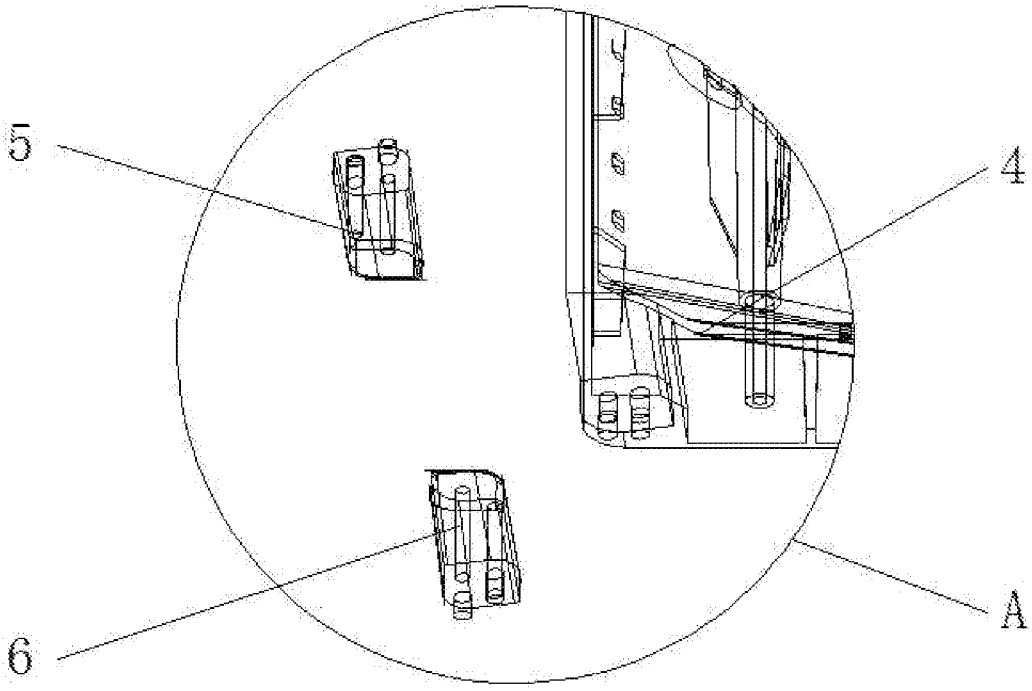
FIG. 4 is a schematic diagram of an A amplifying structure in FIG. 1 of the invention.

Refer to FIG. 1 to FIG. 4, the invention provides a technical solution as follows: an internal functional device for simulative snowfall includes a lampshade 1 having a lamp cover 11 and an air blower 2 on the top and bottom thereof, and a transparent sheet framework 8 at the upper part of the lampshade 1, where the side part of the air blower 2 is connected to an air guide slot 3 with a material collecting slot 4 having an upper hose clamp 5 and a lower hose clamp 6 at left-side upper and lower ends as well as air guide tubes 7 at right-side upper end in the upper end thereof; and a foam particle dispersion net 9 is mounted at the upper part of the transparent sheet framework 8, right-side upper end of which is connected to an air guide elbow 10.

The air blower 2 and the lampshade 1 are fixedly connected, the lampshade 1 and the lamp cover 1*l* are fixedly connected; the air blower 2 is arranged to provide power for the simulative snowfall device, effectively promoting circulation of foam particles inside the simulative snowfall device; the lamp cover 11 is connected to the lampshade 1 for sealing the upper end of the lampshade 1, so that the foam particles are prevented from leaking outsides and falling down under the action of upper pressure of the foam particles;

The material collecting slot 4 and the lampshade 1 are fixedly connected, and the material collecting slot 4 is of tapered structure for effectively separating the air blower 2 partially, so that influence, on the air blower 2, after the foam particles fall down is avoided, and the foam particles are conveniently guided into the air guide tube 7 intensively under the action of the tapered structure of the material collecting slot 4.

The air guide slot 3 and the material collecting slot 4 are in blocking connection for positioning and forming the air guide slot 3 in the material collecting slot 4; the air guide slot 3 is of branched structure for guiding in the foam particles in two directions to disperse the foam particles more uniformly.

The air guide tube 7 and the transparent sheet framework 8 are in blocking connection, the air guide elbow 10 and the transparent sheet framework 8 are in blocking connection; through the blocking connecting structures between the four air guide tubes 7 and the transparent sheet framework 8, firmness and tightness of the air guide tube 7 connecting structure are improved; the upper parts of two air guide tubes 7 at the left side connect with the air guide elbow 10, so that the foam particles are conveniently guided in, and are prevented from flowing back from the air guide tubes 7 at the left side under action of the air guide elbow 10; and the two air guide tubes 7 at the right side are in butt joint to the upper part of the left side of the material collecting slot 4, so that relatively great foam particles can conveniently flow back.

The foam particle dispersion net 9 and the transparent sheet framework 8 are in blocking connection, and are equal in area; the foam particle dispersion net 9 is arranged, so that the foam particles are dispersed under the action of pressure to improve uniformity during falling-down, and can freely fall down slowly; and the blocking connecting structure between the foam particle dispersion net 9 and the transparent sheet framework 8 is convenient for positioning and mounting of the foam particle dispersion net 9, improving firmness in the using process of the foam particle dispersion net 9.

Working principle: for the internal functional device for simulative snowfall, the air blower 2 is firstly mounted on the bottom of the lampshade 1, the air guide slot 3 and the bottom of the material collecting slot 4 are in blocking connection, so that the air guide slot 3 connects with the air blower 2 to provide power to the simulative snowfall device and effectively promote circulation of the foam particles inside the simulative snowfall device; through the tapered structure of the material collecting slot 4, the foam particles are conveniently collected, are guided into the two air guide tubes 7 at the right side under the action of the air blower 2 and the air guide slot 3 and are guided out from the air guide elbow 10 at the upper end; the foam particles reach the upper part of the foam particle dispersion net 9 are freely fall down into the material collecting slot 4 through a single-layer or multilayer foam particle dispersion net 9 to form a foam particle circulating and slow falling-down process; and the two air guide tubes 7 at the right side are in butt joint to the upper part of the left side of the material collecting slot 4, so that relatively great foam particles flow back for secondary treatment, thus accomplishing the whole using process of the internal functional device for simulative snowfall.

While the invention has been demonstrated and described with reference to certain embodiments thereof, it will be understood by those of ordinary skill in the art that various changes, substitutions and alterations can be made herein without departing from the principle and spirit and scope of the invention as defined by the appended claims and equivalents thereof.

The invention claimed is:

1. An internal functional device for simulative snowfall, comprising a lampshade (1) having a transparent sheet framework (8) at an upperpart thereof, wherein, a foam particle dispersion net (9) is installed at the upper part thereof and an air guide elbow (10) is installed at a right-side upper end thereof, wherein a top of the lampshade (1) is provided with a lamp cover (11), and a bottom of the lampshade (1) is provided with an air blower (2), wherein a side part of the air blower (2) is connected to an air guide slot (3) with a material collecting slot (4) having an upper hose clamp (5) and a lower hose clamp (6) at left-side upper and lower ends as well as air guide tubes (7) at right side upper end in the upper end thereof;

wherein the air guide slot (3) is of branched structure, the air guide tubes (7) are provided with four air guide tubes (7).

2. The internal functional device for simulative snowfall according to claim 1, wherein the air blower (2) and the lampshade (1) are fixedly connected, and the lampshade (1) and the lamp cover (11) are fixedly connected.

3. The internal functional device for simulative snowfall according to claim 1, wherein the material collecting slot (4) and the lampshade (1) are fixedly connected, and the material collecting slot (4) is of tapered structure.

4. The internal functional device for simulative snowfall according to claim 1, wherein the air guide slot (3) and the material collecting slot (4) are in clamp connection.

5. The internal functional device for simulative snowfall according to claim 1, wherein the four air guide tubes (7) and the air guide elbow (10) are in clamp connection, and the four air guide tubes (7) and the transparent sheet framework (8) are in clamp connection.

6. The internal functional device for simulative snowfall according to claim 1, wherein the foam particle dispersion net (9) and the transparent sheet framework (8) are in clamp connection, and are equal in area.

* * * * *